US008347424B2

(12) United States Patent
Wroblewski et al.

(10) Patent No.: US 8,347,424 B2
(45) Date of Patent: Jan. 8, 2013

(54) LEVELING MECHANISM FOR FLOOR DRAIN

(75) Inventors: Douglas R. Wroblewski, Erie, PA (US); Carl R. Nicolia, Erie, PA (US); Jonathan Steffan, Erie, PA (US); Mark Marini, Erie, PA (US)

(73) Assignee: Zurn Industries, LLC, Erie, PA (US)

( * ) Notice: Subject to any disclaimer, the term of this patent is extended or adjusted under 35 U.S.C. 154(b) by 50 days.

(21) Appl. No.: 12/371,012

(22) Filed: Feb. 13, 2009

(65) Prior Publication Data

US 2009/0223884 A1 Sep. 10, 2009

Related U.S. Application Data

(60) Provisional application No. 61/034,639, filed on Mar. 7, 2008.

(51) Int. Cl.
*E03C 1/26* (2006.01)
*E04F 17/00* (2006.01)

(52) U.S. Cl. ..... 4/288; 4/289; 4/679; 52/302.1; 285/44; 210/162; 210/164; 137/362

(58) Field of Classification Search ..... 4/286–295, 4/613, 679–680, 695, 688; 285/12, 58, 177, 285/298, 42–44; 210/162–165, 166, 232; 220/42; 240/42, 58, 161, 238, 205; 403/6–8; 137/362.363, 15.01; 52/302.1, 20–21
See application file for complete search history.

(56) References Cited

U.S. PATENT DOCUMENTS 1,766,621 A * 6/1930 Fleming ..... 210/165
1,792,345 A * 2/1931 Williams ..... 210/164
2,190,532 A 2/1940 Lukomski
2,490,075 A 12/1949 Matheis
2,783,852 A * 3/1957 Sisk ..... 210/165
2,859,452 A * 11/1958 Seewack ..... 210/165
2,889,928 A * 6/1959 Sisk ..... 210/163
3,246,582 A 4/1966 Wade et al.
4,067,072 A * 1/1978 Izzi ..... 4/288
4,092,745 A * 6/1978 Oropallo ..... 4/288
4,146,939 A * 4/1979 Izzi ..... 4/286
4,402,625 A * 9/1983 Rechkin ..... 403/7
4,694,513 A * 9/1987 Kiziah ..... 4/288
4,871,451 A 10/1989 Piskula
4,879,771 A 11/1989 Piskula
4,883,590 A * 11/1989 Papp ..... 210/164
6,179,518 B1 1/2001 Suatac
6,269,495 B1 8/2001 Sondrup
6,350,373 B1 2/2002 Sondrup
6,381,775 B1 5/2002 Sondrup
6,687,825 B1 * 2/2004 Challener et al. ..... 713/176
6,766,545 B2 * 7/2004 Hodges ..... 4/679
7,658,043 B2 * 2/2010 Wroblewski ..... 52/302.1
7,735,512 B1 * 6/2010 Ismert et al. ..... 137/362

OTHER PUBLICATIONS

US 2,783,012, 3/1957, Sisk, (withdrawn).*
Sioux Chief Manufacturing, Finish Line Brochure (2007), Peculiar, Missouri.

* cited by examiner

*Primary Examiner* — Jeanette E. Chapman
(74) *Attorney, Agent, or Firm* — The Webb Law Firm

(57) ABSTRACT

A floor drain includes a head having a top surface, a leveling member, and a frame having a top surface and a bottom surface. The bottom surface of the frame is positioned adjacent the top surface of the head. The leveling member is positioned between the head and the bottom surface of the frame and is displaceable relative to the head in a first direction. A method of leveling a floor drain with a floor surface is also disclosed.

23 Claims, 7 Drawing Sheets

LEVELING MECHANISM FOR FLOOR DRAIN

CROSS REFERENCE TO RELATED APPLICATIONS

This application claims the benefit of U.S. Provisional Application No. 61/034,639, filed Mar. 7, 2008, the entire contents of which are hereby incorporated by reference.

BACKGROUND OF THE INVENTION

1. Field of the Invention

The present invention relates to floor drains, more particularly, to floor drains having a leveling mechanism.

2. Description of Related Art

A floor drain is used to funnel liquids from a floor surface into a drain pipe. The floor drain typically has a grate attached to the top drain to allow liquid to flow through the drain, but prevent larger solid objects from entering the floor drain. A particular type of floor drain known as "an adjustable floor drain", as shown in FIGS. 1 and 2, employs a strainer 10, a head 20, a membrane clamp collar 30, and a lower body 40. The head 20 has a long threaded shank 22 that allows the head 20 to be adjusted upwardly and downwardly via a mating thread 32 in the membrane clamp collar 30. The head unit 20 is generally a one-piece component with the long threaded shank 22 extending upwardly and transitioning to a larger diameter flank portion 24 having a machined shoulder portion 26. The machined shoulder portion 26 of the head 20 receives the grate or strainer 10, which is typically secured to the head 20 using machine screws. The clamp collar 30 is secured to the lower body 40 via machine screws 43. The lower body 40 defines a passageway 44 therethrough for receiving a drain pipe 46.

Referring to FIG. 2, a problem develops during the installation of these types of drains due to variances associated with the finished floor height and pitch. During installation, the lower body 40, clamp collar 30 and head 20 are positioned, supported, and leveled. The head 20 is screwed up or down to adjust to a desired height using the threaded shank 22 and mating thread 32. Concrete 50 is poured to encase the entire assembly just below or up to the top level of the head 20 and a finished floor surface 55, such as ceramic or quarry tile, is laid on the top of the concrete 50. A problem can occur at this time if the head unit 20 of the drain assembly was incorrectly adjusted to compensate for the total thickness of the finished floor surface 55, e.g., the tile and thin set mortar. If the top surface of the head 20 is too low, then the strainer 10 will not be flush with the finished floor surface 55. Further, if the pitch of the concrete 50 and the finished floor surface 55 is not level with the top surface of the head 20, the strainer 10 will not be level or flush with the finished floor surface 55.

SUMMARY OF THE INVENTION

A floor drain includes a head having a top surface, a leveling member, and a frame having a top surface and a bottom surface. The bottom surface of the frame is positioned adjacent the top surface of the head. The leveling member is positioned between the head and the bottom surface of the frame and is displaceable relative to the head in a first direction.

In one embodiment, the frame defines an access opening and the leveling member is at least partially aligned with the access opening. The leveling member may have a top surface with at least a portion of the top surface of the leveling member being configured to engage a bottom surface of the frame. The floor drain may further include a top plate positioned adjacent the top surface of the frame. The frame may be substantially ring-shaped and further include a shoulder positioned on the perimeter of the frame for receiving the top plate. The head may include a threaded shank defining a central passageway and having a flange portion extending outwardly from the threaded shank.

In a certain embodiment, the leveling member may be a screw with the flange portion of the head defining an opening for threadably receiving the screw. The flange portion of the head may define a plurality of spaced apart threaded openings and the frame may define a plurality of spaced apart openings, where the threaded openings of the head are aligned with the openings of the frame. A plurality of screws may be provided to secure the frame to the head via the threaded openings of the head and the openings of the frame. The top plate may be strainer defining a plurality of flow passages and a plurality of openings and the frame may define a plurality of threaded openings. The plurality of openings in the strainer being aligned with the plurality of threaded openings in the frame. A plurality of screws may be provided to secure the strainer to the frame via the plurality of openings in the strainer and the plurality of threaded openings in the frame.

The floor drain may be provided with a collar defining a passageway therethrough and having a flange portion. The threaded shank of the head engages the threaded portion of the collar. The floor drain may also include a body defining a passageway therethrough and having a flange portion. The collar may engage the flange portion of the body. Further, the floor drain may include a plurality of leveling members with each leveling member being circumferentially spaced from each other and positioned between the head and the bottom surface of the frame with each leveling member being displaceable relative to the head in a first direction.

In a further embodiment, a method for leveling a floor drain relative to a floor surface is provided. The method includes the step of providing a floor drain having a head with a top surface, a leveling member, and a frame having a top surface and a bottom surface. The bottom surface of the frame is positioned adjacent the top surface of the head and the leveling member is positioned between the head and the frame. The method further includes the step of displacing the leveling member in a first direction such that the leveling member engages the bottom surface of the frame. The engagement of the leveling member with the bottom surface of the frame may displace the bottom surface of the frame to substantially level the frame with the floor surface.

The floor drain may further include a top plate positioned adjacent the top surface of the frame. The frame may further define an access opening and at least a portion of the leveling member may be aligned with the access opening. The floor drain may further include a plurality of leveling members with each leveling member being circumferentially spaced from each other and positioned between the head and the bottom surface of the frame. The method may further include the step of selectively displacing one or more of the plurality of leveling members to rotate the frame about a first axis and a second axis. The second axis is substantially perpendicular to the first axis, where the first and second axes lie in a plane substantially parallel to the top surface of the frame.

DETAILED DESCRIPTION OF THE INVENTION

Figure 1:
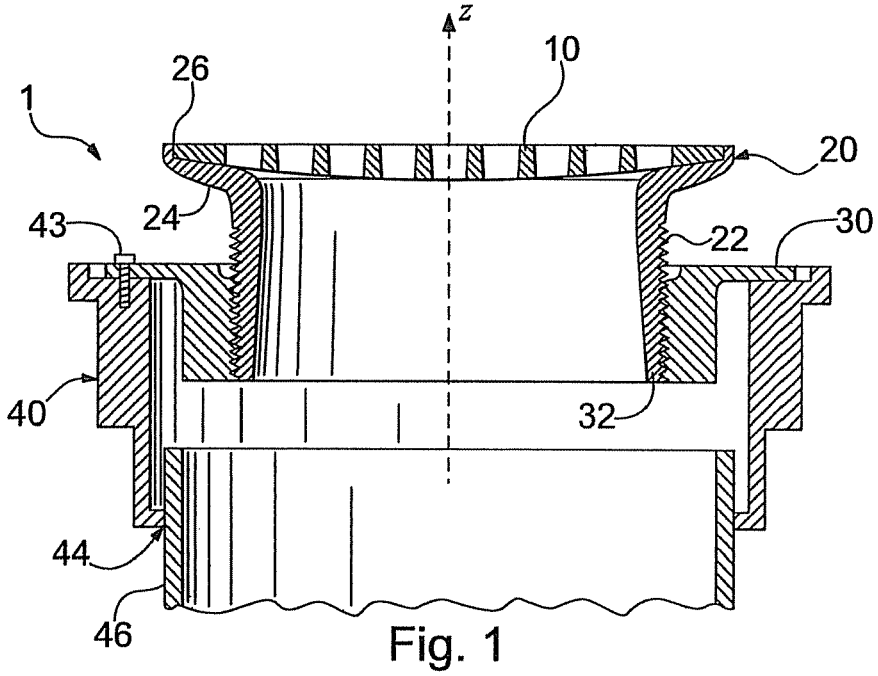
Fig. 1 (PRIOR ART)
FIG. 1 is a cross-sectional view of a prior art floor drain assembly.
Figure 2:
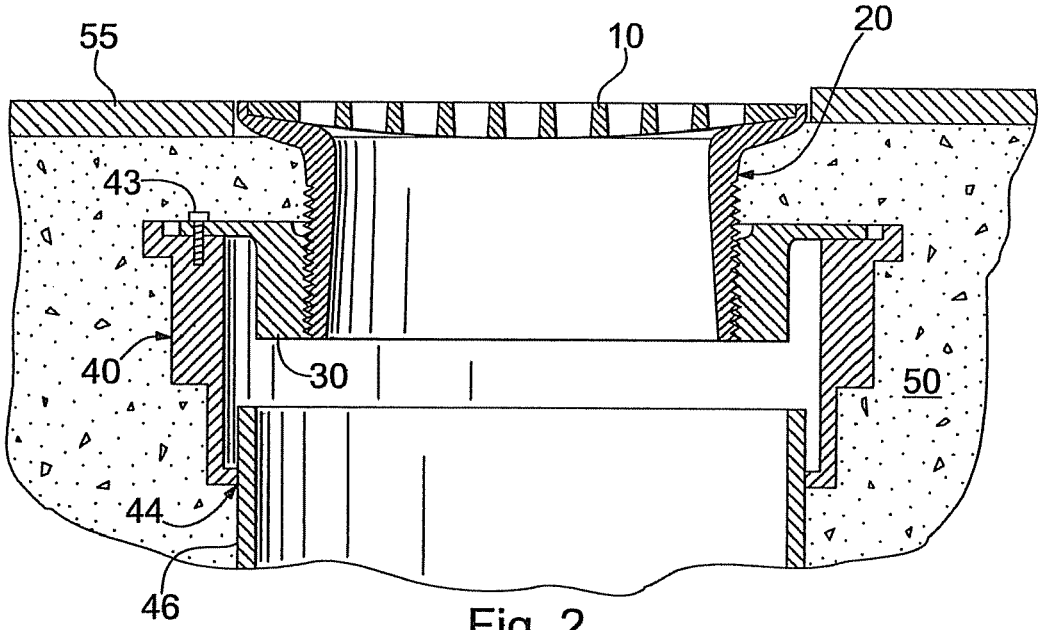
Fig. 2 (PRIOR ART)
FIG. 2 is a cross-sectional view of the prior art floor drain assembly of FIG. 1, showing the floor drain assembly in an installed position.

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

According to one embodiment, shown in FIGS. 3-12, a floor drain assembly 100 includes a top plate 110, a frame 120, a head 140, a collar 160, and a lower body 170.

Figure 5:
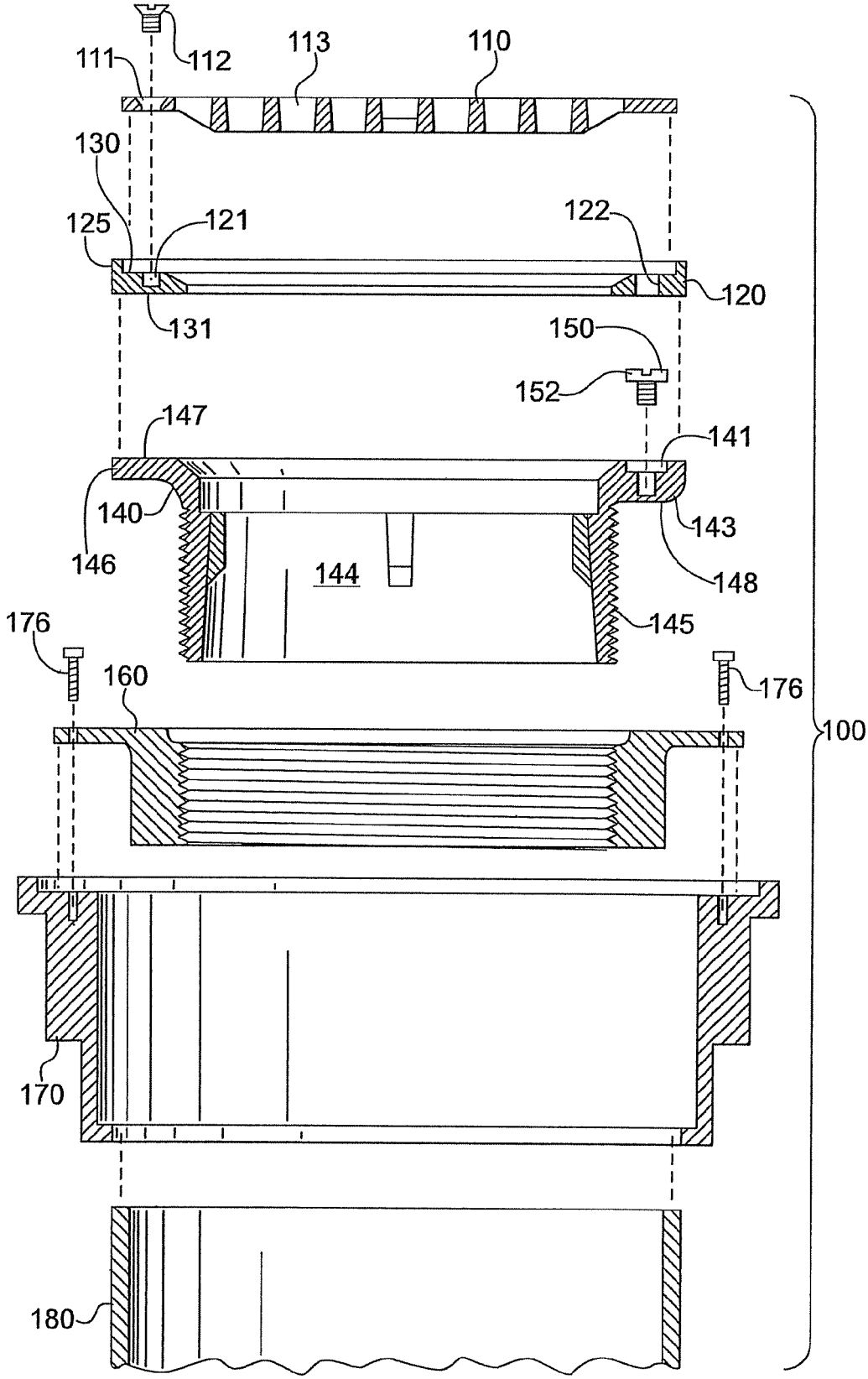
FIG. 5 is an exploded cross-sectional view of the floor drain assembly of FIG. 1.
Figure 6:
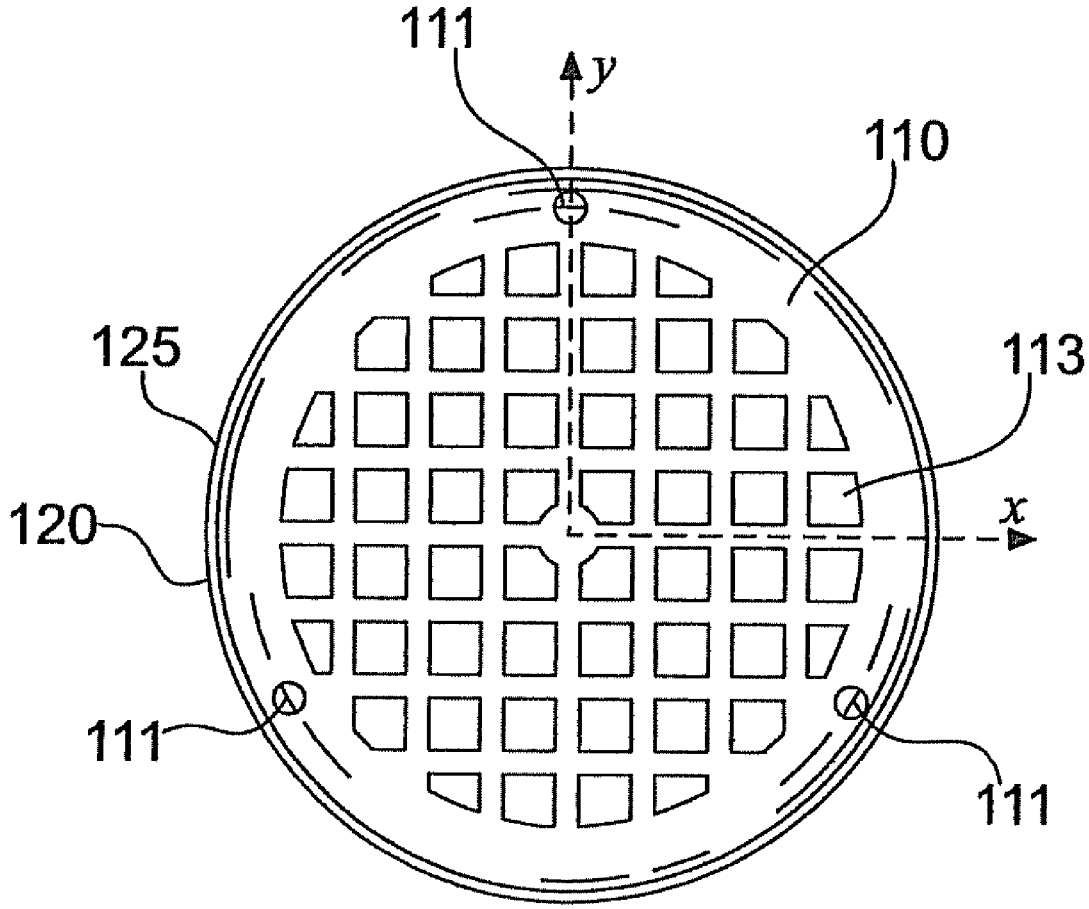
FIG. 6 is top view of the floor drain assembly of FIG. 1.
Figure 7:
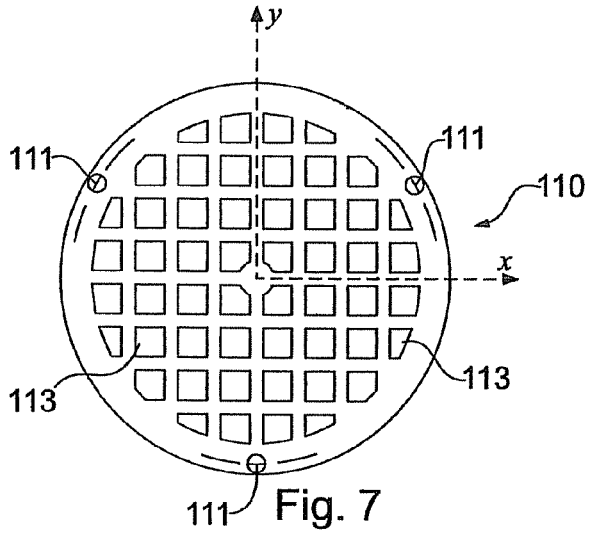
FIG. 7 is a top view of the strainer shown in FIG. 1.

Referring to FIGS. 5 and 7, the top plate 110 is a circular strainer and defines a plurality of openings 111 and a plurality of flow passages 113. The flow passages 113 permit the flow of fluid therethrough, but prevent the passage of solids of a particular size. As shown in FIG. 6, the top plate 110 includes three equally spaced apart openings 111 on the perimeter of the top plate 110, although other numbers of openings 111 may be provided. Further, although the top plate 110 is shown as a strainer in this particular embodiment, the top plate 110 may also be a solid cover for use as a floor cleanout.

Figure 3:
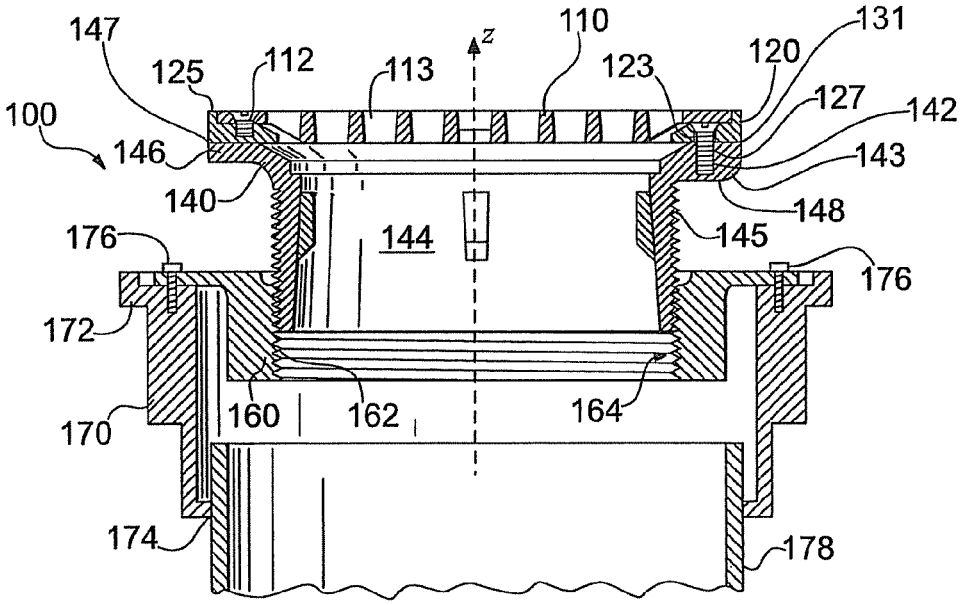
FIG. 3 is a cross-sectional view of a floor drain assembly according to one embodiment of the present invention.
Figure 8:
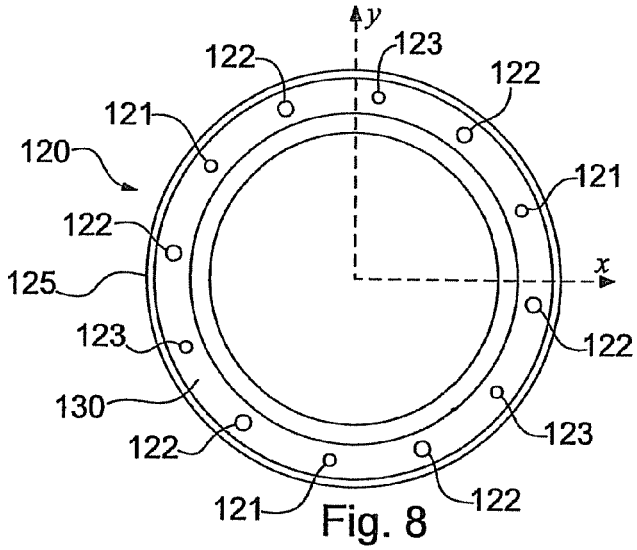
FIG. 8 is a top view of the frame shown in FIG. 1.

Referring to FIGS. 3, 5 and 8, the frame 120 is substantially ring-shaped and defines three threaded openings 121, six access openings 122, and three openings 123, although other numbers of threaded openings 121, access openings 122, and openings 123 may be provided. The frame 120 has a top surface 130 and a bottom surface 131 with a shoulder 125 extending from the top surface 130 of the frame 120 and positioned on the perimeter of the frame 120. The shoulder 125 is dimensioned to receive the top plate 110 such that the top plate 110 and the top of the frame 120 are flush when mated together. The three openings 123 are positioned on the perimeter of the frame 120 adjacent the shoulder 125. The six access openings 122 are circumferentially spaced apart on the frame 120 adjacent the shoulder 125.

Figure 9:
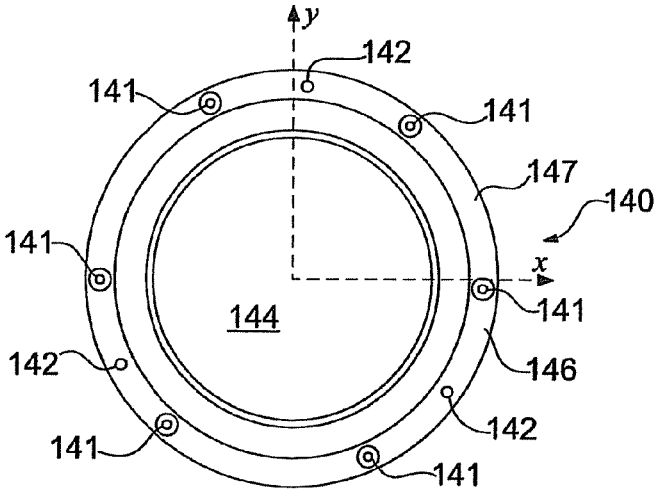
FIG. 9 is a top view of the head shown in FIG. 1.

Referring to FIGS. 5 and 9, the head 140 is cylindrical in shape and defines a central passage 144 extending therethrough. The head 140 is provided with an externally threaded shank 145 and a flange portion 146 extending outward from the threaded shank 145. The flange portion 146 of the head 140 includes a top surface 147 and a bottom surface 148. The head 140 further defines six leveling member openings 141 and three threaded openings 142 positioned on the flange portion 146 of the head 140. Further, the six leveling member openings 141 of the head 140 threadably receive six leveling members 150. As shown more clearly in FIG. 5, the leveling members 150 can be Allen flat head screws and the leveling member openings 141 can be counterbored such that a top surface 152 of each of the leveling members 150 can be flush with the top surface 147 of the head 140. However, the leveling members 150 and the leveling member openings 141 may have other suitable shapes, such as a flat top countersunk screw with a corresponding countersunk opening for receiving the screw. Each of the leveling members 150 is displaceable relative to the head unit 140 in a direction substantially parallel to the z-axis shown in FIGS. 3-5 and 10-12.

Figure 4:
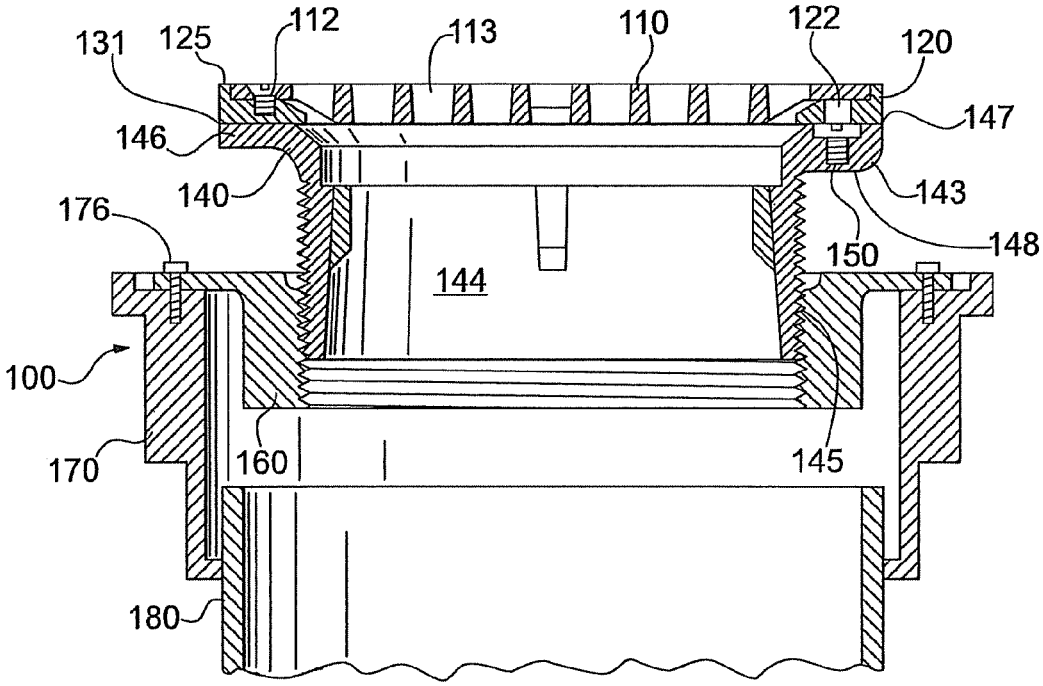
FIG. 4 is a cross-sectional view of the floor drain assembly of FIG. 1, showing an access hole and leveling screw.

Referring to FIGS. 3-5, when the floor drain 100 is assembled, the bottom surface 131 of the frame 120 is positioned adjacent to the top surface 147 of the head 140. The plurality of openings 123 in the frame 120 are aligned with the threaded openings 142 in the head 140. The frame 120 is attached to the head 140 with screws 127 inserted through the openings 123 and engaged with the threaded openings 142 in the head 140. The openings 123 in the frame 120 may be countersunk allowing the screws 127 to be flush with the top surface 130 of the frame 120. The access openings 122 in the frame 120 are aligned with the leveling member openings 141 in the head unit 140. The leveling members 150 engage the leveling member openings 141 in the head unit 140 and are adjustable by accessing the top surface 152 of each of the leveling members 150 via the access holes 122 in the frame 120. Accordingly, the leveling members 150 may be displaced relative to the head 140 in a direction substantially parallel to the z-axis by adjustment through the access openings 122.

As discussed below in more detail, the top surface 152 of the leveling members 150 and the access openings 122 are sized such that at least a portion of the leveling members 150 engage the bottom surface 131 of the frame 120 upon displacement of the leveling members 150. Thus, as shown in FIGS. 4-5, the access opening 122 is smaller than the top surface 152 of the leveling members 150. The access opening 122, however, is large enough to accommodate a tool for engaging and causing displacement of the leveling members 150 toward the bottom surface 131 of the frame 120. As shown in FIGS. 3, 4 and 10-12, the head 140 includes a plurality of bosses 143 on the bottom surface 148 of the flange portion 146 for receiving the leveling members 150 and the screws 127.

Referring to FIGS. 3 and 6, the top plate 110 is positioned adjacent the top surface 130 of the frame 120 such that the top plate 110 is surrounded by the shoulder 125 of the frame 120 and is flush with the top of the shoulder 125. The plurality of openings 111 in the strainer 110 are aligned with the threaded openings 121 in the frame 120. The strainer 110 is attached to the frame 120 with screws 112 inserted through the openings 111 in the strainer 110 and engaged with the threaded openings 121 of the frame 120. The plurality of openings 111 in the strainer 110 may be countersunk which corresponds to the heads of the screws 112 such that the screws 112 are flush with the top of the strainer 110 after assembly with the frame 120.

Referring to FIGS. 3 and 4, upon assembly of the floor drain 100, the threaded shank 145 of the head unit 140 secures the floor drain 100 to a mating thread 162 of the collar 160 allowing for upward and downward adjustment of the floor drain 100 in the direction of the z-axis. The collar 160 defines a passageway 164 therethrough and is secured to a flange portion 172 of the lower body 170 via screws 176. The lower body 170 defines a passageway 174 therethrough for receiving a drain pipe 178. The drain pipe 178 may be secured to the lower body 170 via a friction fit with chalking, e.g., oakum and lead, provided between the inside of the lower body 170 and the outside of the drain pipe 178. Any other suitable arrangements for securing the drain pipe 178 to the lower body 170 may be provided.

Figure 10:
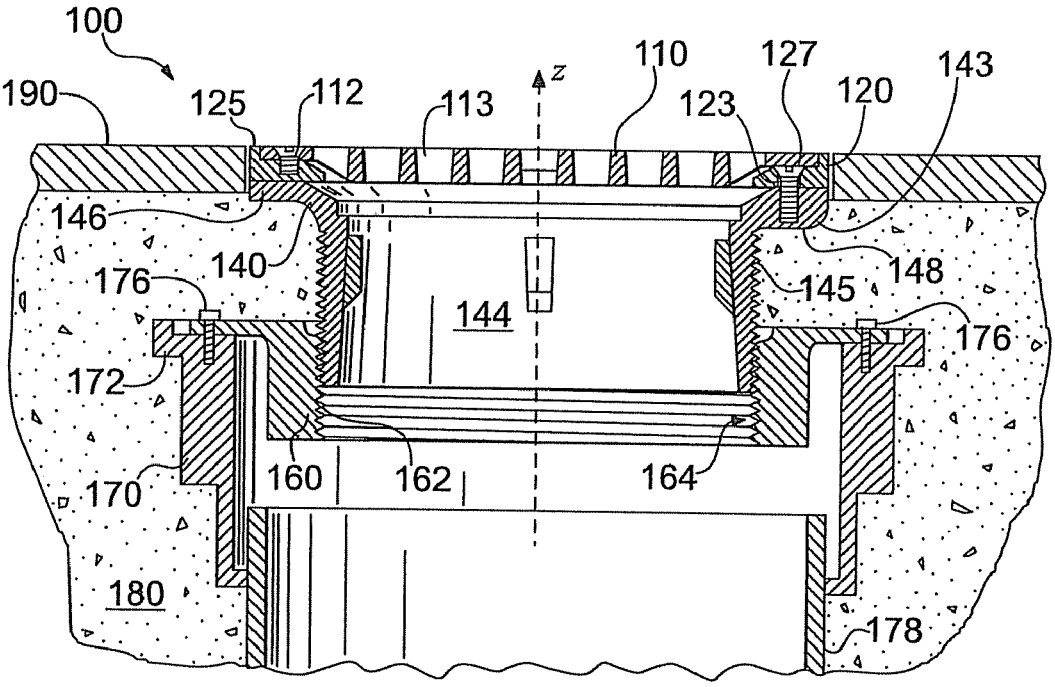
FIG. 10 is a cross-sectional view of the floor drain assembly of FIG. 1, showing the floor drain assembly installed with a level finished floor.

Referring to FIG. 10, after the floor drain 100 is secured to the collar 160 and the head unit 140 is adjusted to a sufficient height, concrete 180 is poured to encase the floor drain just below or up to the top surface 147 of the head unit 140 and a finished floor surface 190, such as ceramic or quarry tile, is laid on the top of the cured concrete 180. In a particular installation, as shown in FIG. 10, the concrete 180 and the finished floor surface 190 have the same pitch relative to the frame 120. Further, the shoulder 125 of the frame 120 is positioned at the same height as the finished floor surface 190. The top plate 110 is secured to the frame 120 such that the shoulder 125 and top plate 110 are flush with the finished floor surface 190. In such an installation, no adjustment of the frame 120 is necessary.

Figure 11:
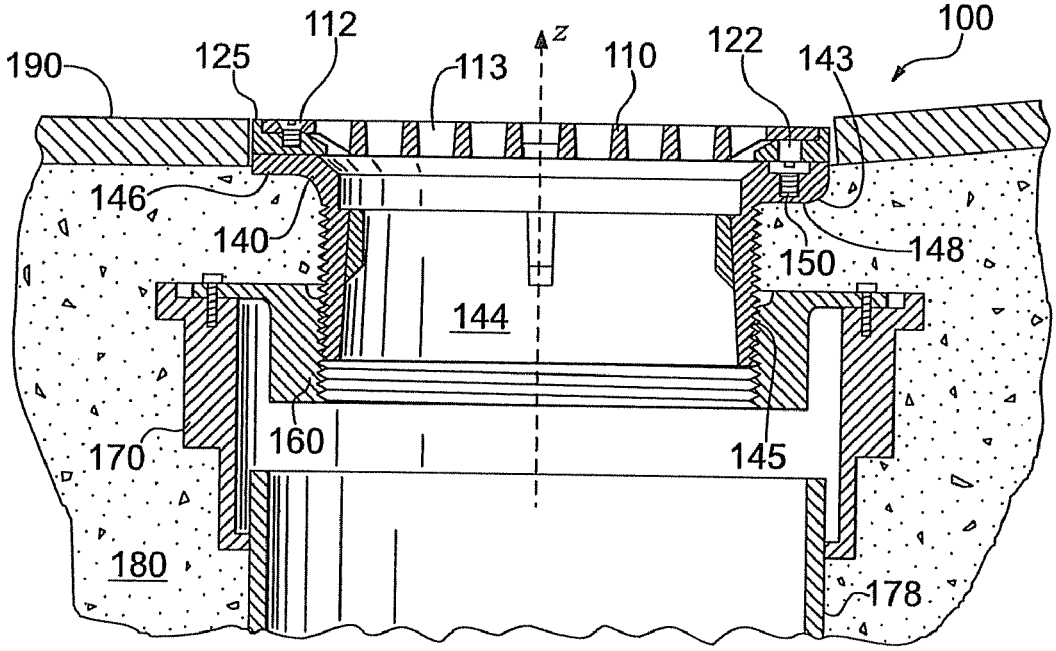
FIG. 11 is a cross-sectional view of the floor drain assembly of FIG. 1, showing the floor drain assembly installed and unleveled with a pitched finished floor.
Figure 12:
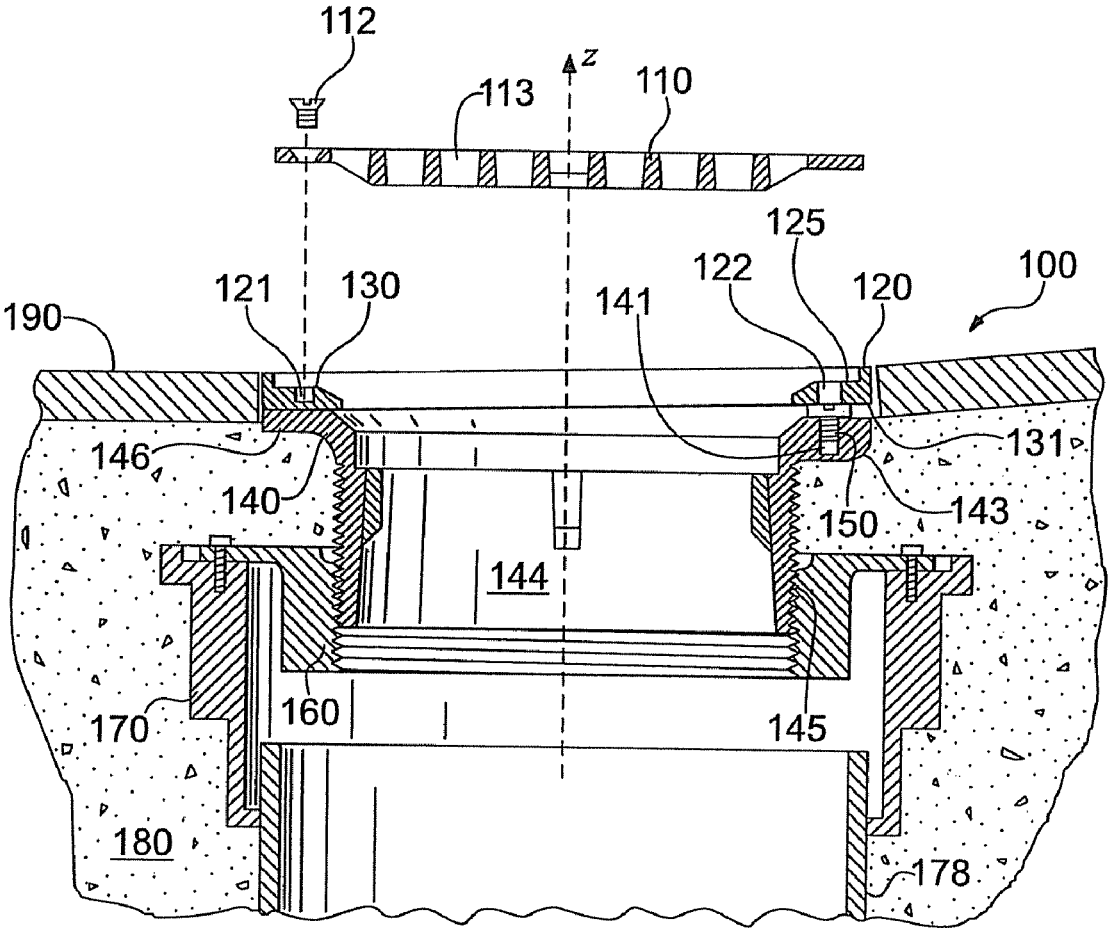
FIG. 12 is a cross-sectional view of the floor drain assembly of FIG. 1, showing the floor drain assembly installed and leveled with a pitched finished floor.

Referring to FIGS. 11 and 12, in certain installations of the floor drain 100, the concrete 180 and finished floor surface 190 are not level with the top surface 130 of the frame 120 such that the top plate 110 will not be flush with the finished floor surface 190. In order to adjust the pitch of the frame 120 and top plate 110, the top plate 110 is detached from the frame 120 by removing the screws 112. Next, the screws 127 securing the frame 120 to the head 140 are loosened to allow movement of the frame 120 in the direction of the z-axis. With the top plate 110 detached and the screws 127 loosened, the leveling members 150 may be adjusted upwardly in the direction of the z-axis, as shown in FIG. 12, by accessing the leveling members 150 through the access openings 122 in the frame 120. As noted above, the leveling members 150 can be Allen flat head machine screws and can be adjusted through the access openings 122 in the frame 120 using an Allen wrench, although other suitable leveling members 150 and adjustment arrangements may be provided.

The upward adjustment of the leveling members 150 causes the top surface 152 of the leveling members 150 to engage the bottom surface 131 of the frame 120 which lifts or displaces the frame 120 upward relative to the top surface 147 of the head 140. Thus, the leveling members 150 and the frame 120 coact with each other such that upward movement of the leveling members 150 causes upward movement of the frame 120. In particular, by adjusting one or more of the six leveling members 150 to displace the leveling members 150 upwardly in the direction of the z-axis, the frame 120 and top plate 110 are rotatable about both a y-axis and an x-axis, shown in FIGS. 6-9. The x-axis is substantially perpendicular to the y-axis and the x-axis and the y-axis lie in a plane substantially parallel to the top surface 130 of the frame 120. Therefore, the adjustment of the leveling members 150 allows the pitch and height of the frame 120 and top plate 110 to be changed. Further, although the head 140, as shown in FIG. 9, is arranged to provide six leveling members 150, the floor drain 100 may include one or more leveling members 150 to adjust the pitch or height of the top plate 110 and frame 120.

The frame 120 may be adjusted evenly to adjust the overall height of the floor drain 100 or unevenly to adjust the pitch of the floor drain 100. If the frame 120 is raised unevenly, the leveling members 150 between the high and low sides may be adjusted upwardly until such leveling members 150 contact the bottom surface 131 of the frame 120 to further support the frame 120. After reaching the desired pitch of the frame 120, the screws 127 are inserted into the openings 123 in the frame 120 and engage the threaded openings 142 in the head 140 such that the frame 120 is drawn tight against the top surface 152 of the leveling members 150. The top plate 110 is then attached to the frame 120 using the screws 112. Similarly, if the frame 120 is raised evenly, the leveling members 150 are adjusted upwardly the same distance and the screws 127 are tightened to secure the frame 120 against the top surface 152 of the leveling members 150. In particular embodiments, the gap between the top surface 147 of the head 140 and the bottom surface 131 of the frame 120 may be filled in with caulking or grout. Further, as shown in FIG. 6, the top plate 110 covers the leveling members 150 and screws 127, so as to hide the access openings 122 and the presence of the leveling members 150.

While certain embodiments of the floor drain were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A structure positioned adjacent to a floor surface for connecting to a drain pipe, the structure comprising:

a head having a top surface;

a leveling member attached to the head, the leveling member having a top surface; and a frame having a top surface and a bottom surface, the bottom surface of the frame positioned adjacent the top surface of the head, wherein a bottom surface of the frame and the top surface of the leveling member coact with each other, the top surface of the leveling member being positioned below the bottom surface of the frame, the leveling member displaceable relative to the head in a first direction.

2. The structure of claim 1, wherein the frame defines an access opening, at least a portion of the leveling member being aligned with the access opening.

3. The structure of claim 1, wherein at least a portion of the top surface of the leveling member is configured to engage the bottom surface of the frame.

4. The structure of claim 1, further comprising a top plate positioned adjacent the top surface of the frame.

5. The structure of claim 4, wherein the frame is substantially ring-shaped and further comprises a shoulder positioned on the perimeter of the frame for receiving the top plate.

6. The structure of claim 1, wherein the head has a threaded shank defining a central passageway and a flange portion extending outwardly from the threaded shank.

7. The structure of claim 6, wherein the leveling member comprises a screw and the flange portion of the head defines an opening for threadably receiving the screw.

8. A structure positioned adjacent to a floor surface for connecting to a drain pipe, the structure comprising:

a head having a top surface, a threaded shank defining a central passageway, and a flange portion extending outwardly from the threaded shank;

a leveling member attached to the head, the leveling member having a top surface; and a frame having a top surface and a bottom surface, the bottom surface of the frame positioned adjacent the top surface of the head, wherein a bottom surface of the frame and the top surface of the leveling member coact with each other, the top surface of the leveling member being positioned below the bottom surface of the frame, the leveling member displaceable relative to the head in a first direction, wherein the leveling member comprises a screw and the flange portion of the head defines an opening for threadably receiving the screw, and wherein the flange portion of the head defines a plurality of spaced apart threaded openings and the frame defines a plurality of spaced apart openings, the threaded openings of the head being aligned with the openings of the frame.

9. The structure of claim 8, wherein a plurality of screws secures the frame to the head via the threaded openings of the head and the openings of the frame.

10. The structure of claim 4, wherein the top plate comprises a strainer defining a plurality of flow passages and a plurality of openings, and wherein the frame defines a plurality of threaded openings, the plurality of openings in the strainer being aligned with the plurality of threaded openings in the frame.

11. The structure of claim 10, wherein a plurality of screws secures the strainer to the frame via the plurality of openings in the strainer and the plurality of threaded openings in the frame.

12. The structure of claim 6, further comprising a collar defining a passageway therethrough and having a threaded portion, the threaded shank of the head engaging the threaded portion of the collar.

13. A structure positioned adjacent to a floor surface for connecting to a drain pipe, the structure comprising:

a head having a top surface, the head having a threaded shank defining a central passageway and a flange portion extending outwardly from the threaded shank;

a leveling member attached to the head, the leveling member having a top surface;

a frame having a top surface and a bottom surface, the bottom surface of the frame positioned adjacent the top surface of the head;

a collar defining a passageway therethrough and having a threaded portion, the threaded shank of the head engaging the threaded portion of the collar; and a lower body defining a passageway therethrough and having a flange portion, the collar engaging the flange portion of the body, wherein a bottom surface of the frame and the top surface of the leveling member coact with each other, the top surface of the leveling member being positioned below the bottom surface of the frame, the leveling member displaceable relative to the head in a first direction extending away from the head, and wherein the leveling member is configured to increase a distance between the frame and the head at a position adjacent to the leveling member.

14. The structure of claim 1, further comprising a plurality of leveling members, each leveling member being circumferentially spaced from each other, and each leveling member positioned between the head and the bottom surface of the frame and displaceable relative to the head in the first direction.

15. The structure of claim 1, wherein the structure is configured to be utilized as a floor cleanout.

16. A structure positioned adjacent to a floor surface for connecting to a drain pipe, the structure comprising:

a drain body having a top surface;

a frame having a top surface and a bottom surface, the bottom surface of the frame positioned adjacent to the top surface of the drain body, the frame secured to the drain body via a plurality of fasteners;

a top plate positioned adjacent to the top surface of the drain body, the top plate having a bottom surface; and a leveling member attached to the drain body, the leveling member having a top surface positioned below the bottom surface of the top plate, the leveling member displaceable relative to the drain body in a first direction extending away from the drain body, wherein the leveling member is configured to increase a distance between the drain body and the top plate at a position adjacent to the leveling member.

17. The structure of claim 16, wherein the drain body comprises a head having a threaded shank defining a central passageway and a flange portion extending outwardly from the threaded shank.

18. The structure of claim 16, wherein the top surface of the frame positioned adjacent to the bottom surface of the top plate.

19. The structure of claim 18, wherein the frame defines an access opening, at least a portion of the leveling member being aligned with the access opening.

20. The structure of claim 18, wherein at least a portion of the top surface of the leveling member is configured to engage the bottom surface of the frame.

21. The structure of claim 16, wherein the leveling member comprises a screw threadably engaged with the drain body.

22. The structure of claim 16, wherein the top plate comprises a strainer.

23. The structure of claim 16, wherein the structure is configured to be utilized as a floor cleanout.

* * * * *

UNITED STATES PATENT AND TRADEMARK OFFICE

CERTIFICATE OF CORRECTION

PATENT NO. : 8,347,424 B2
APPLICATION NO. : 12/371012
DATED : January 8, 2013
INVENTOR(S) : Douglas R. Wroblewski et al.

It is certified that error appears in the above-identified patent and that said Letters Patent is hereby corrected as shown below:

On the Title Page, Column 1, Item (56) References Cited, insert -- 6,687,925 B2* Minnick --

Signed and Sealed this
Thirteenth Day of August, 2013

Teresa Stanek Rea
*Acting Director of the United States Patent and Trademark Office*